US011959712B1

(12) United States Patent
Canny

(10) Patent No.: US 11,959,712 B1
(45) Date of Patent: Apr. 16, 2024

(54) FIRING MECHANISM FOR A SEMI-AUTOMATIC FIREARM, KIT AND METHOD

(71) Applicant: Declan Canny, Drexel Hill, PA (US)

(72) Inventor: Declan Canny, Drexel Hill, PA (US)

( * ) Notice: Subject to any disclaimer, the term of this patent is extended or adjusted under 35 U.S.C. 154(b) by 0 days.

(21) Appl. No.: 18/107,737

(22) Filed: Feb. 9, 2023

(51) Int. Cl.
*F41A 19/31* (2006.01)
*F41A 19/12* (2006.01)

(52) U.S. Cl.
CPC ..... *F41A 19/31* (2013.01); *F41A 19/12* (2013.01)

(58) Field of Classification Search
CPC ..... F41A 19/31; F41A 19/12; F41A 19/24; F41A 19/32
USPC ..... 42/69.01, 69.02
See application file for complete search history.

(56) References Cited

U.S. PATENT DOCUMENTS 5,705,763 A 1/1998 Leon
6,308,448 B1 * 10/2001 Kapusta ..... F41A 19/31 42/69.02
8,510,980 B2 * 8/2013 Lee ..... F41A 19/10 42/69.01
9,303,936 B2 4/2016 Toner
D815,233 S 4/2018 Toner
10,514,223 B1 12/2019 Rounds
10,684,087 B2 6/2020 Thomele
2020/0080801 A1 * 3/2020 O'Clair ..... F41A 3/66

OTHER PUBLICATIONS

Sig Sauer "Owner's Manual: Handling and Safety Instructions," P/N 8501300-01 Rev 00.

* cited by examiner

*Primary Examiner* — Reginald S Tillman, Jr.
(74) *Attorney, Agent, or Firm* — Robert J. Yarbrough of Lipton, Weinberger & Husick

(57) ABSTRACT

A firing mechanism for a striker-fired, magazine-fed semi-automatic pistol includes a linear cam that is attached to and moves with a slide. The linear cam moves a cam follower that pivots a reset bar. The reset bar bears upon a trigger bar projection, moving the trigger bar projection out of engagement with a lower end of a sear lower arm as the slide closes. Interference between the reset bar and the trigger bar projection prevents a second pull of the trigger from releasing the sear and moving the sear to the firing position to fire a second round until the pistol is in battery, while allowing the shooter to achieve a high rate of semi-automatic fire.

19 Claims, 10 Drawing Sheets

FIRING MECHANISM FOR A SEMI-AUTOMATIC FIREARM, KIT AND METHOD

I. BACKGROUND OF THE INVENTION

A. Field of the Invention

The Invention is a firing mechanism for a magazine fed, slide-operated, semi-automatic firearm, which may be a pistol, that is capable of selectable rapid fire. The Invention is also a method and kit of parts for modifying a conventional semi-automatic firearm using the apparatus of the Invention. The Invention allows a shooter to achieve a higher rate of semi-automatic fire by allowing the shooter to pull the trigger after the firing mechanism has been mechanically reset While the following describes the Invention in relation to a pistol, the Invention is equally applicable to any firearm.

B. Statement of the Related Art

As used in this document, the terms 'forward direction' refers to the direction parallel to the longitudinal axis of the barrel of the pistol and in the direction of travel of a bullet leaving the barrel of the pistol. The term 'rearward direction' is the direction opposite to the forward direction. The terms 'upward' or 'upward direction' refer to a direction normal to the forward and rearward directions and oriented toward the slide and away from the magazine and grip of the pistol. The terms 'downward' or 'downward direction' refers to a direction opposite to the upward direction. The terms 'transverse' or 'transverse direction' refers to a direction normal to the longitudinal axis of the barrel and normal to the upward direction and downward direction.

A conventional striker-fired pistol, such as a P320 ® pistol from Sig Sauer®, 72 Pease Blvd, Newington, NH 03801, has a barrel, a slide, a magazine, and a spring-loaded striker. A sear has a cocked position and a firing position. In the cocked position, the sear traps the spring-loaded striker, preventing the striker from moving forward to strike the primer of a cartridge that is loaded in the chamber. In the firing position, the sear does not trap the striker and does not block the forward movement of the striker. U.S. Pat. No. 10,684,087 to Thomele issued Jun. 16, 2020, showing operation of a prior art Sig Sauer striker-fired pistol, is hereby incorporated by reference as if set forth in full herein. The 'Sig Sauer P320 Owner's Manual: Handling and Safety Instructions,' Sig Sauer® P/N 8501300-91 REV 00 is also incorporated by reference as if set forth in full herein.

For the conventional striker-fired pistol, when the sear is in the cocked position and a shooter's finger pulls the trigger in the rearward direction, the trigger pivots about a trigger pivot axis and causes a trigger bar to move in the forward direction. The trigger bar includes a trigger bar projection that moves with the trigger bar so that movement of the trigger bar in the forward direction moves the trigger bar projection to a forward position. As the trigger bar projection moves to the forward position, the moving trigger bar projection engages a sear lower arm, causing the sear lower arm to move in the forward direction. The sear lower arm is attached to the sear and movement of sear lower arm by the trigger bar projection causes the sear to rotate about a transversely-oriented sear pivot axis from the cocked position to the firing position. When the rotating sear moves to the firing position, a sear engagement surface on the sear rotates away from a striker catch, releasing the striker catch and the spring-loaded striker attached to the striker catch. The striker, now released, is propelled in the forward direction by a striker spring. The firing pin of the striker impacts the primer of a cartridge in the chamber, firing the cartridge and propelling the bullet down the barrel in the forward direction.

The recoil of the fired cartridge moves the slide and striker rearward, ejecting the spent cartridge case and moving a disconnector in a downward direction to a downward position. In moving to the downward position, the disconnector pushes the trigger bar downward so that the trigger bar projection is below the sear lower arm. When the disconnector is in the downward position, the trigger bar projection is disengaged from the sear lower arm so that the position of the trigger does not affect the position of the sear. The disconnector thus prevents the shooter's finger on the trigger from firing a cartridge 'out of battery;' that is, when the slide is not fully closed and the breech face of the slide does not fully cover the breech to form a closed firing chamber. Firing of a pistol out of battery would present a safety risk.

The slide reaches the limit of its rearward travel, reverses direction and moves in the forward direction under spring pressure; that is, the slide reciprocates or cycles. As the slide moves in the forward direction, the shooter's finger still is depressing the trigger because the cycling of the slide after firing of a cartridge occurs faster than the shooter can physically release the trigger. As the slide moves in the forward direction, the disconnector is still in the downward position and has disengaged the sear from the trigger bar projection, so the sear is free to rotate about the sear axis of rotation. A sear spring rotates the sear about the sear axis of rotation and returns the sear to the cocked position. As the slide moves in the forward direction, the sear engagement surface, now in the cocked position, engages and stops the striker catch, preventing the striker from moving forward. The slide continues to move forward, compressing the striker spring. As the slide moves in the forward direction, the slide strips a fresh cartridge from the magazine and pushes the cartridge into the chamber.

As the slide reaches the limit of its forward travel, the disconnector moves upward and disengages from the trigger bar, allowing the trigger bar projection to move in the upward direction. Because the shooter is still depressing the trigger, the trigger bar projection is still in the forward position. The upward-moving trigger bar projection in the forward position is stopped by and bears upon the lower end of the sear lower arm. Because any force applied to the sear lower arm by the trigger bar projection acts substantially through the sear pivot axis, the force applied by the shooter's finger to the trigger, acting through the trigger bar and trigger bar projection to the sear does not apply a moment to the sear and hence does not cause the sear to rotate. The force applied by the shooter's finger on the trigger therefore does not cause the sear to release the striker and does not cause the pistol to fire out of battery.

When the slide has returned forward to the fully closed position, the pistol is now in battery with a fresh round in the chamber and the sear in the cocked position and holding the striker under spring pressure. The pistol still is not ready to fire until the shooter manually resets the mechanism by releasing the trigger. When the shooter releases the trigger, the trigger moves in the forward direction under spring pressure, pivoting about the trigger pivot axis and causing the trigger bar to move in the rearward direction. The rearward-moving trigger bar disengages the trigger bar projection from the lower end of the sear lower arm, allowing the trigger bar projection to move upward. The trigger bar projection is now directly aft of the sear lower arm and ready to engage the sear lower arm when the trigger is again pulled. The prior-art pistol is now ready to fire again.

The prior art pistol may include a slide rear cap. The slide rear cap is releasably attached to the rear end of the slide and moves with the slide as the slide cycles. The slide rear cap engages grooves in the slide and is retained in position by spring pressure from an extractor spring. The slide rear cap can be readily removed and replaced by releasing extractor spring pressure and sliding the slide rear cap out of or into engagement with the slide.

II. Brief Description of the Invention

The Invention is a firing mechanism for a striker-fired, magazine-fed pistol, such as the P320 ® pistol manufactured by Sig Sauer®. The Invention operates in the manner of the prior art, except as discussed below. In summary, after the pistol fires a round and as the slide cycles, the firing mechanism of the Invention selectably moves the trigger bar rearward and out of vertical engagement with the sear lower arm. When the shooter pulls the trigger again, the trigger pull causes the trigger bar to pivot the sear to the sear firing position and causes the pistol to fire a second time as soon as the slide is fully closed and the pistol is in battery. The Invention provides a semiautomatic firearm mechanism that increases the rate by allowing the user to pull the trigger as soon as the action has been mechanically reset. The shooter can selectably disable the Invention so that the shooter must manually reset the trigger between rounds.

The components of the firing mechanism that allow the pistol of the Invention to fire rapidly include a linear cam and a reset bar having a cam follower. The linear cam is attached to a housing that is selectably attachable to and removable from the rear of the slide. The housing and hence the linear cam reciprocate along with the slide when the housing is attached to the slide. The linear cam may have two selectable positions with respect to the housing and hence to the slide—a first, or forward, position in which the linear cam will engage the cam follower when the slide cycles, and a second, or rearward, position in which the linear cam will not engage the cam follower when the slide cycles. The linear cam may be movable with respect to the housing and may be selectably fixed in either the forward position or the rearward positions. The shooter may selectably fix the linear cam in the forward or rearward position using any mechanism known in the art, such as a movable pin, a spring, a clip, a fastener, a bayonet connection or any other technique known in the art for selectably and reversibly fixing one object with respect to another. When the linear cam is in the rearward position, the pistol operates in the same manner as the prior art pistol described above. When the linear cam is in the forward position, the pistol operates as described below.

The reset bar is attached to the frame of the pistol and pivots about a transversely-oriented reset bar pivot axis. The reset bar pivot axis may be co-extensive with the sear pivot axis and may be supported and pivot about the sear pin.

The cam follower is part of the reset bar and rides upon the linear cam when the linear cam is in the forward position. The cam follower follows the profile of the linear cam, moving in substantially upward and downward directions as the linear cam reciprocates with the slide. The cam follower causes the reset bar to pivot about the sear pivot axis as the slide reciprocates. The reset bar has a reset bar lower end that pivots with the reset bar and that bears upon the trigger bar.

While the prior-art disconnector controls the motion of the trigger bar in the upward and downward directions as the slide cycles, the linear cam and reset bar control the motion of the trigger bar in the forward and rearward directions as the slide cycles. When the slide cycles and the linear cam engages the cam follower, the cam follower moves in generally the upward and downward directions. The moving cam follower causes the reset bar to pivot about the reset bar pivot axis and the pivot bar lower end to move in generally the rearward and forward directions. As the slide cycles, the pivot bar lower end limits the motion of the trigger bar in the forward direction and moves the trigger bar in the rearward direction. The linear cam therefore controls the position of the trigger bar in the forward and rearward direction as the slide cycles.

As in the prior art, when the shooter pulls the trigger of a pistol equipped with the Invention, the trigger bar moves in the forward direction and encounters the sear lower arm, causing the sear to rotate about the sear pivot axis, releasing the striker and causing the pistol to fire, all as described above. The slide is propelled in the rearward direction by recoil, ejecting the spent cartridge case.

As the slide moves in the rearward direction, the linear cam also moves in the rearward direction with the slide. The linear cam has a first slope facing in the rearward direction and a second slope facing in the forward direction. When the slide moves in the rearward direction, the first slope of the linear cam encounters the cam follower and moves the cam follower in the substantially upward direction. Motion of the cam follower in the upward direction causes the reset bar to pivot about the sear pivot axis. The reset bar lower end bears upon the trigger bar and pushes the trigger bar in the rearward direction, which pushes the trigger in the forward direction. Simultaneously, the slide pushes on the disconnector and the disconnector moves the trigger bar in the downward direction, so that the trigger bar and the trigger bar projection move in the downward direction. Motion of the trigger bar in the rearward direction (by the reset bar) and in the downward direction (by the disconnector) removes the trigger bar projection from engagement with the sear lower arm.

As the slide continues to move in the rearward direction, the cam follower continues to follow the profile of the linear cam and moves in the downward direction along the second slope of the linear cam. The downward motion of the cam follower and resulting pivot of the reset bar about the sear axis of rotation allow the trigger bar to move in the forward direction under the pressure of the shooter's finger on the trigger.

The slide reaches the limit of its travel in the rearward direction, reverses direction under spring pressure and moves in the forward direction. The forward-moving slide moves the disconnector in the upward direction, as discussed above. The upward movement of the disconnector allows the trigger bar and hence the trigger bar projection to move upward, until the upward movement of the trigger bar projection is stopped by the lower end of the sear lower arm. The trigger bar projection bears momentarily on the lower end of the sear lower arm. As discussed above, the trigger bar projection acts through the sear pivot axis about a sear pin, so any force applied to the end of the sear lower arm by the trigger bar projection does not apply a moment to the sear, does not rotate the sear, and does not cause the pistol to fire out of battery.

As the slide continues to move in the forward direction, the cam follower again encounters the second slope of the linear cam. The second slope pushes the cam follower in the upward direction, which causes the reset bar to pivot about the sear axis of rotation and to push the trigger bar projection, and hence the trigger bar, in the rearward direction and out of engagement with the lower end of the sear lower arm. At this moment in the cycle, the trigger bar projection is behind the sear lower arm and does not interfere with the sear lower arm.

As the slides approaches the limit of its travel in the forward direction, the cam follower continues to follow the profile of the linear cam and moves in the downward direction along the cam first slope. The downward movement of the cam follower causes the reset bar to pivot about the sear axis of rotation so that the reset bar lower end moves in the forward direction, which allows the trigger bar projection and the trigger bar to move in the forward direction. The shooter again presses the trigger, causing the trigger bar and trigger bar projection to move forward and to bear on the sear lower arm, rotating the sear about the sear pivot axis, releasing the striker and firing the pistol a second time. The pistol is fully in battery when the second and subsequent rounds are fired. The pistol will only fire when the cycle is complete and there is external force acting upon the trigger after each cycle.

All of the above actions occur within a small fraction of a second. While the above discussion describes actions as occurring sequentially, with one action completing before another begins, in actuality there is considerable overlap between the actions in the sequence. While the above discussion addresses a striker-fired pistol, the discussion is equally applicable to a hammer-fired pistol, or to a striker-fired or hammer-fired long gun.

The apparatus of the Invention includes a housing that may be removably attached to the rear of the slide of the pistol using the same mechanism as the slide rear cap of the prior art is attached to the rear of the slide. Alternatively, the housing may be releasably attached to the rear of the slide using any other mechanism known in the art, such as screws or other fasteners, adhesive, grooves, an interference fit, T-channels or other channels, or any other suitable mechanism that allows the housing to reciprocate with the slide. The housing may include the linear cam. The linear cam may have a selectable forward position and a selectable rearward position with respect to the housing. The linear cam in the forward position may engage the cam follower as described above. The linear cam in the rearward position may not engage the cam follower. The shooter may slide the linear cam between the forward or rearward positions by disengaging and engaging a selector pin.

The method of the invention involves the steps of obtaining a housing having a linear cam. The housing may be attachable to the rear of the slide in place of a prior art slide rear cap using the same mechanism that a prior art slide rear cap attaches to the slide. The linear cam reciprocates with the slide when the housing is attached to the slide and may have a selectable forward position and a selectable rearward position with respect to the slide when the housing is attached to the slide. The method also provides for obtaining a reset bar configured to pivot about a reset bar pivot axis and having a cam follower and a reset bar lower end. The method also involves attaching the reset bar to the frame of the pistol so that the reset bar and the sear are pivotable about a common pivot axis and so that the reset bar lower end can bear upon the trigger bar or trigger bar projection when the linear cam is in the forward position and the cam follower follows the cam profile as the slide cycles.

The kit of the invention comprises a housing including the linear cam attached to a housing that is configured for releasable attachment to the slide as described above, and the reset bar, as described above. The kit optionally may include instructions for installing the housing and reset bar on the pistol.

III. Brief Description of the Drawings

IV. Description of an Embodiment

Figure 4:
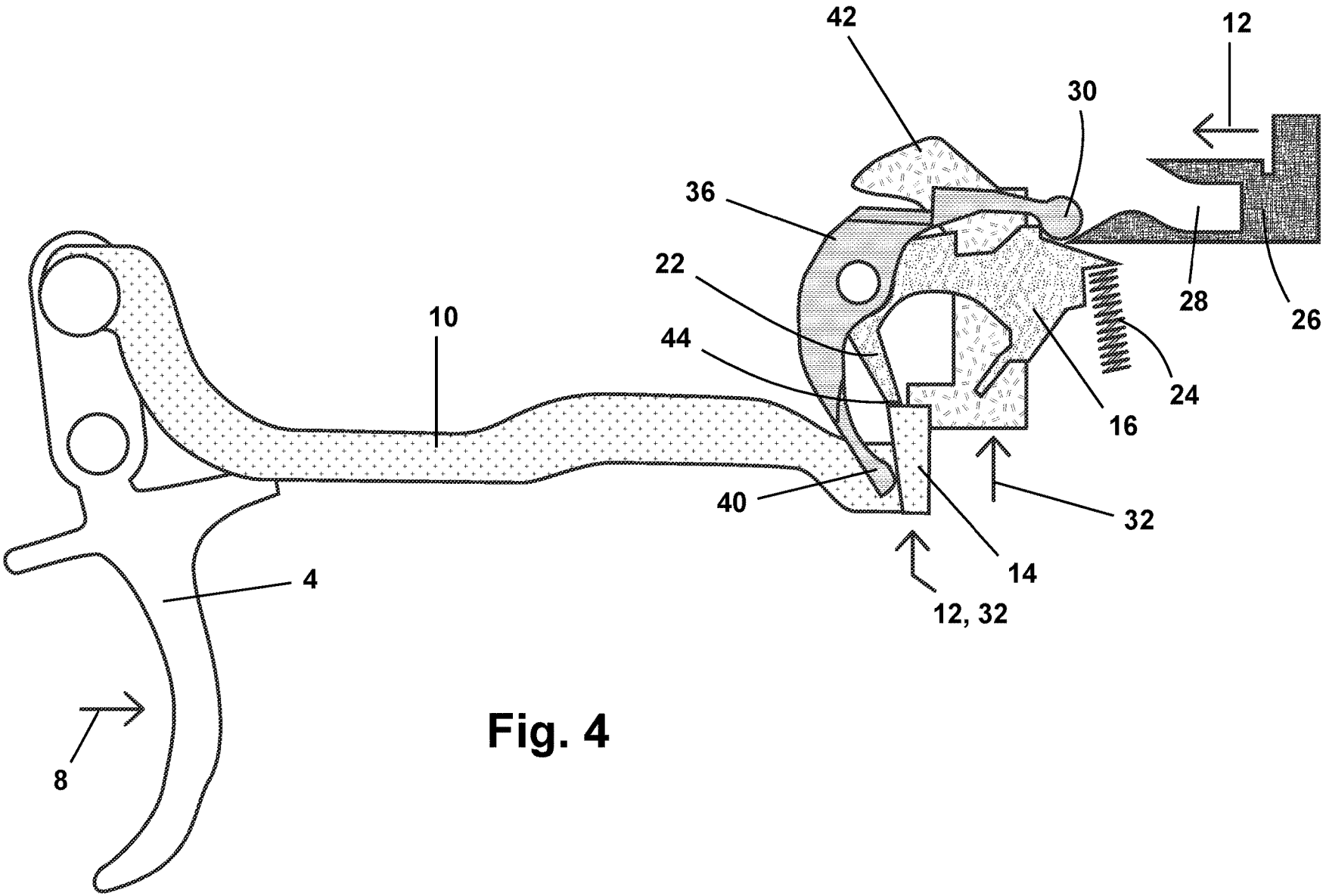
FIG. 4 is the schematic side view immediately after the side view of FIG. 3 when the slide is moving in the forward direction.
Figure 5:
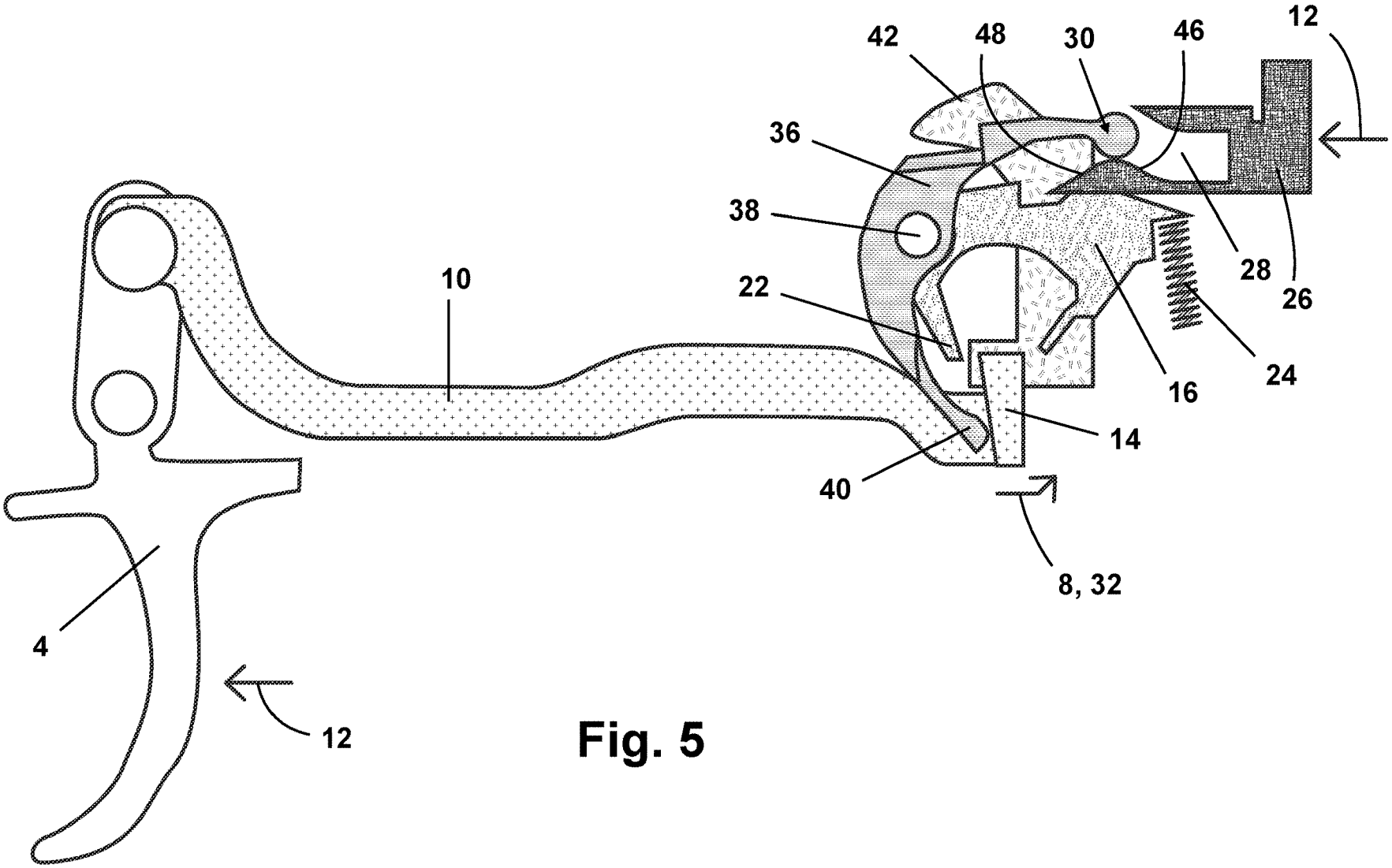
FIG. 5 is the schematic side view immediately after the side view of FIG. 4 when the slide continues to move in the forward direction.
Figure 6:
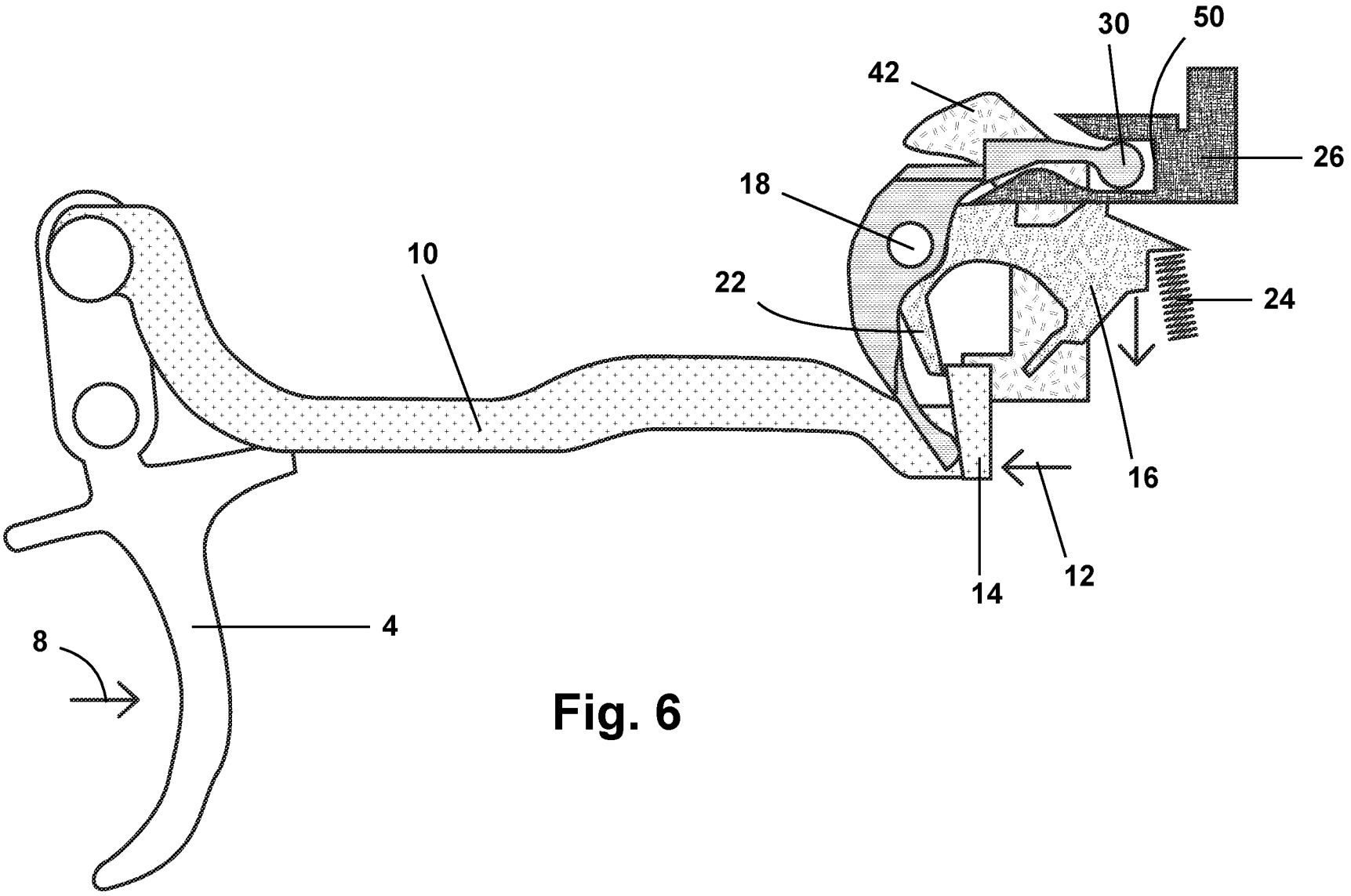
FIG. 6 is the schematic side view immediately after the side view of FIG. 5 when the firearm is in battery and the finger of the shooter presses on the trigger to fire another round.
Figure 7:
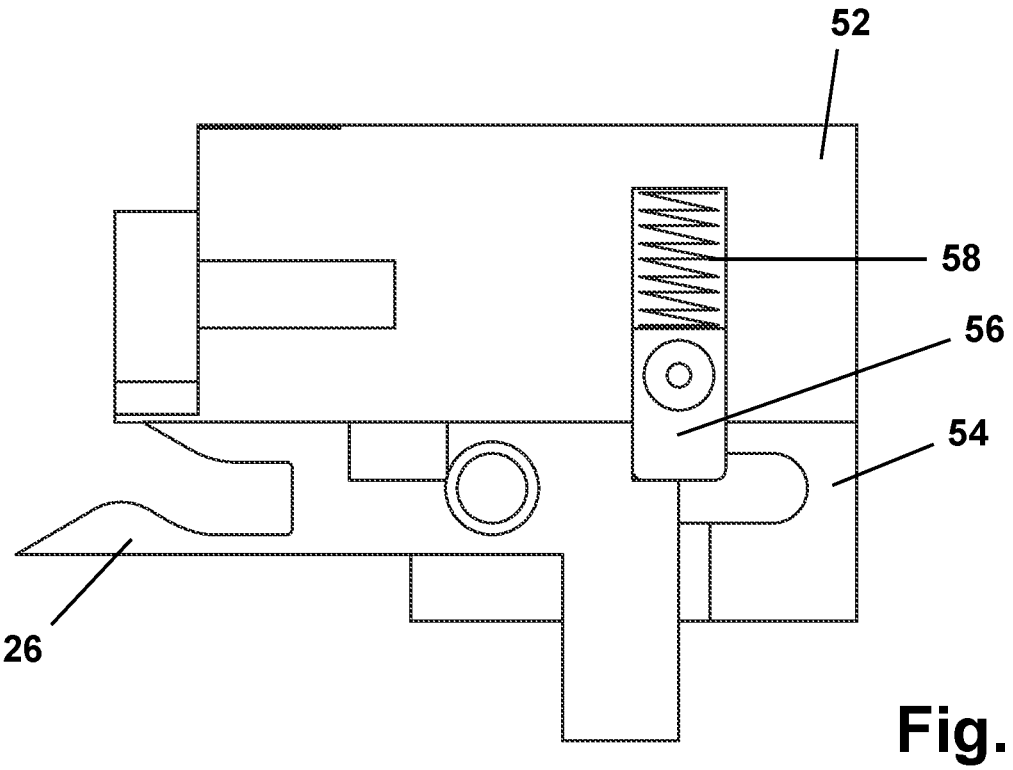
FIG. 7 is a schematic cutaway side view of the housing with the linear cam in the forward position.
Figure 8:
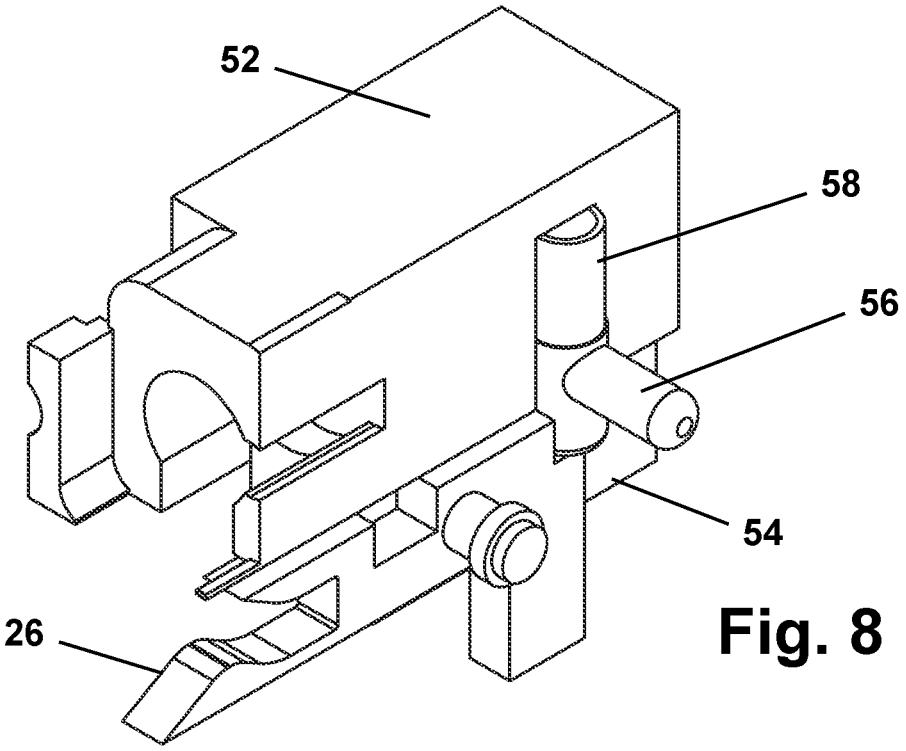
FIG. 8 is a perspective cutaway view of the housing with the linear cam in the forward position.

FIGS. 1 through 6 show the firing mechanism of the Invention from the ready-to-fire condition (FIG. 1) through the firing of the pistol (FIG. 2), cycling of the slide 64 (FIGS. 3-5), and firing a second or subsequent round (FIG. 6). FIGS. 7 through 12 show a housing 52 that is attachable to and detachable from the rear of the slide 64. The housing 52 includes a linear cam 26 and an example mechanism for selecting between rapid fire, as shown by FIGS. 1-6, and conventional fire described in the statement of the related art. In FIGS. 1-6, the housing 52 along with the linear cam 26 is attached to rear of the slide 64 and rapid fire is selected. FIGS. 1-6 do not show the pistol frame 62, magazine, striker, striker arm, striker spring, barrel, slide 64 and cartridge, all of which are conventional and as shown or described in the document incorporated by reference. The slide 64 and frame 62 are shown schematically by FIGS. 11 and 12.

Figure 1:
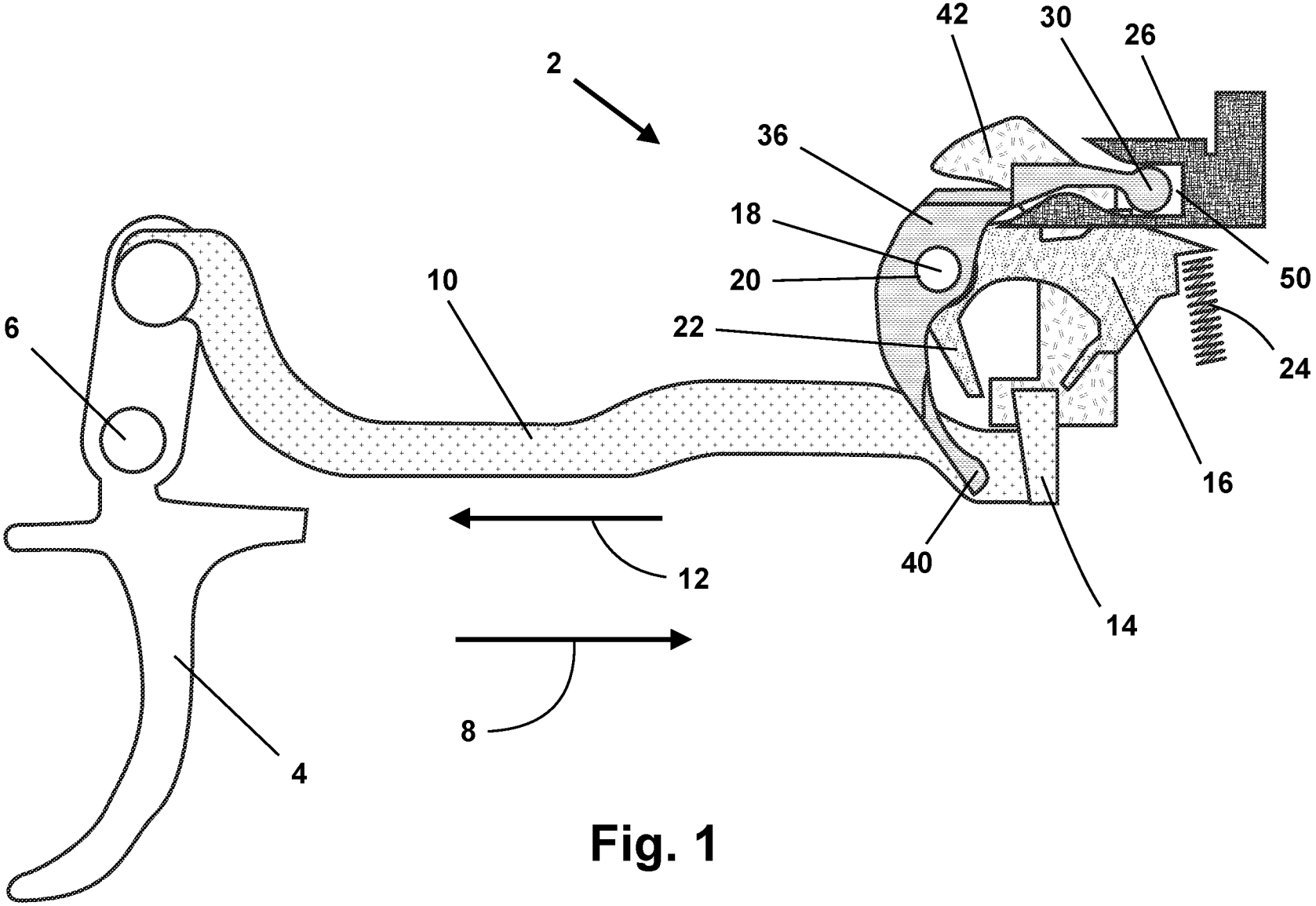
FIG. 1 is a schematic side view of the firing mechanism of the Invention in the ready-to-fire condition.

FIG. 1 shows the firing mechanism 2 of the Invention with the housing 52 attached to the rear of the slide 64, the linear cam 26 in the forward (rapid-fire) position, and with the pistol ready to fire. From FIG. 1, the firing mechanism 2 includes a trigger 4 that pivots about a trigger axis of rotation 6. Movement of the trigger 4 in a rearward direction 8 causes a trigger bar 10, which is attached to the trigger 4, to move in the forward direction 12. The trigger bar 10 includes a trigger bar projection 14 that moves with the trigger bar 10 in the forward direction 12 when the shooter depresses the trigger 4 in the rearward direction 8. The 'forward direction 12' is the direction in which a bullet fired by the pistol will travel. The 'rearward direction 8' is opposite to the forward direction 12.

From FIG. 1, when the firing mechanism 2 is ready to fire, the trigger bar projection 14 is located immediately aft; that is, rearward, of the sear lower arm 22. The sear lower arm 22 is part of the sear 16, which pivots about a sear pivot axis 18 defined by a sear pin 20. The sear 16 has a cocked position, shown by FIG. 1, in which a sear engagement surface retains a spring-loaded striker and prevents the striker from moving forward under spring pressure to strike the primer of the cartridge and fire the pistol.

Figure 2:
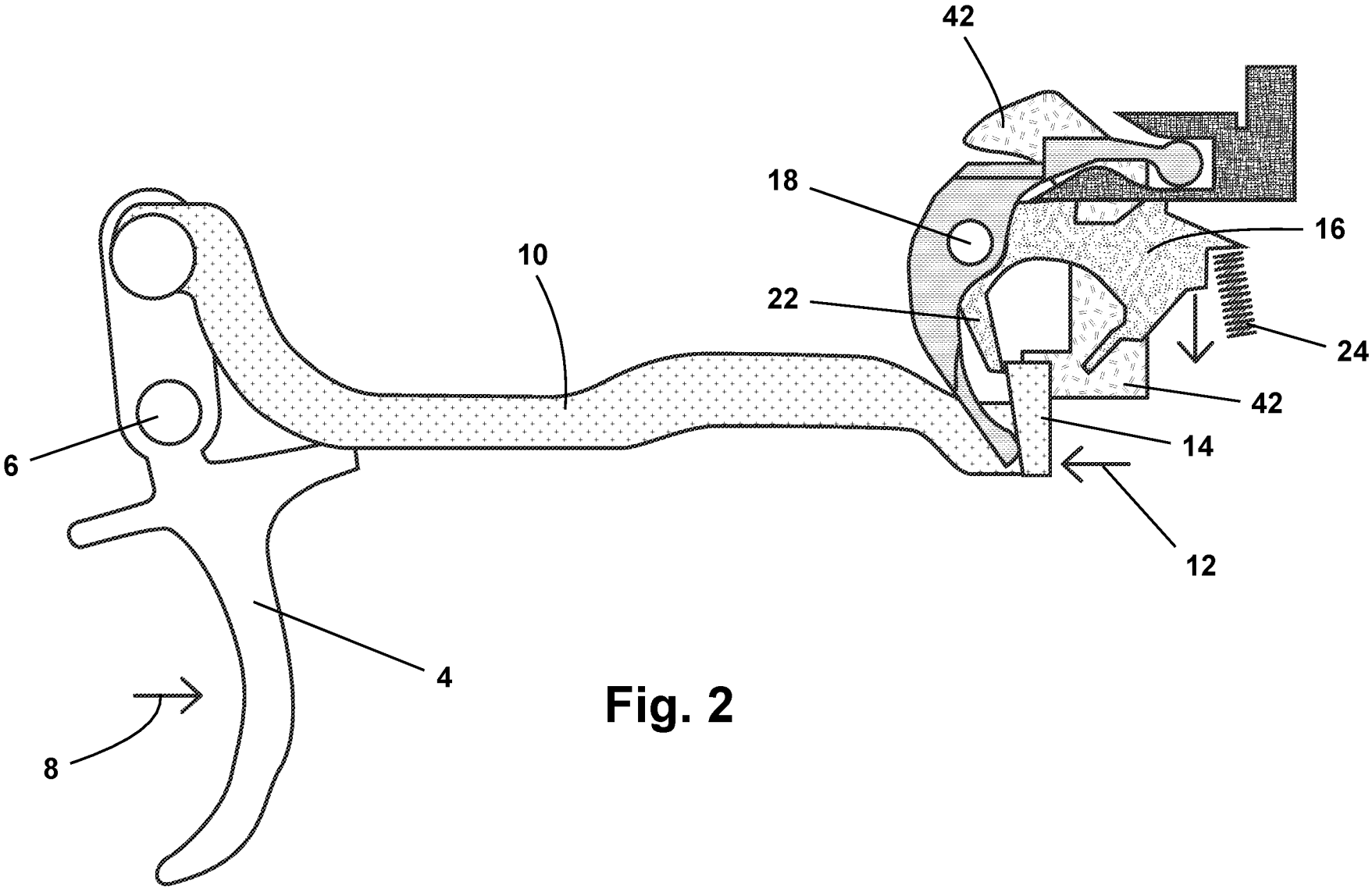
FIG. 2 is the schematic side view of FIG. 1 when the shooter depresses the trigger to fire the firearm.

FIG. 2 shows the firing mechanism after the time of FIG. 1 and when the shooter's finger moves the trigger 4 in the rearward direction 8 to fire the pistol. The trigger 4 pivots about the trigger axis of rotation 6 and moves the trigger bar 10 and the trigger bar projection 14 in the forward direction 12. The trigger bar projection 14 engages the sear lower arm 22 and pushes the sear lower arm 22 in the forward direction 12. The sear 16 pivots about the sear pivot axis 18 from the cocked position (FIG. 1) to the firing position (FIG. 2). The sear 16 releases the striker (not shown), which is propelled forward by the striker spring (not shown) to strike the primer of the cartridge (not shown) to fire the pistol. The motion of the sear 16 to the firing position compresses the sear spring 24.

Figure 3:
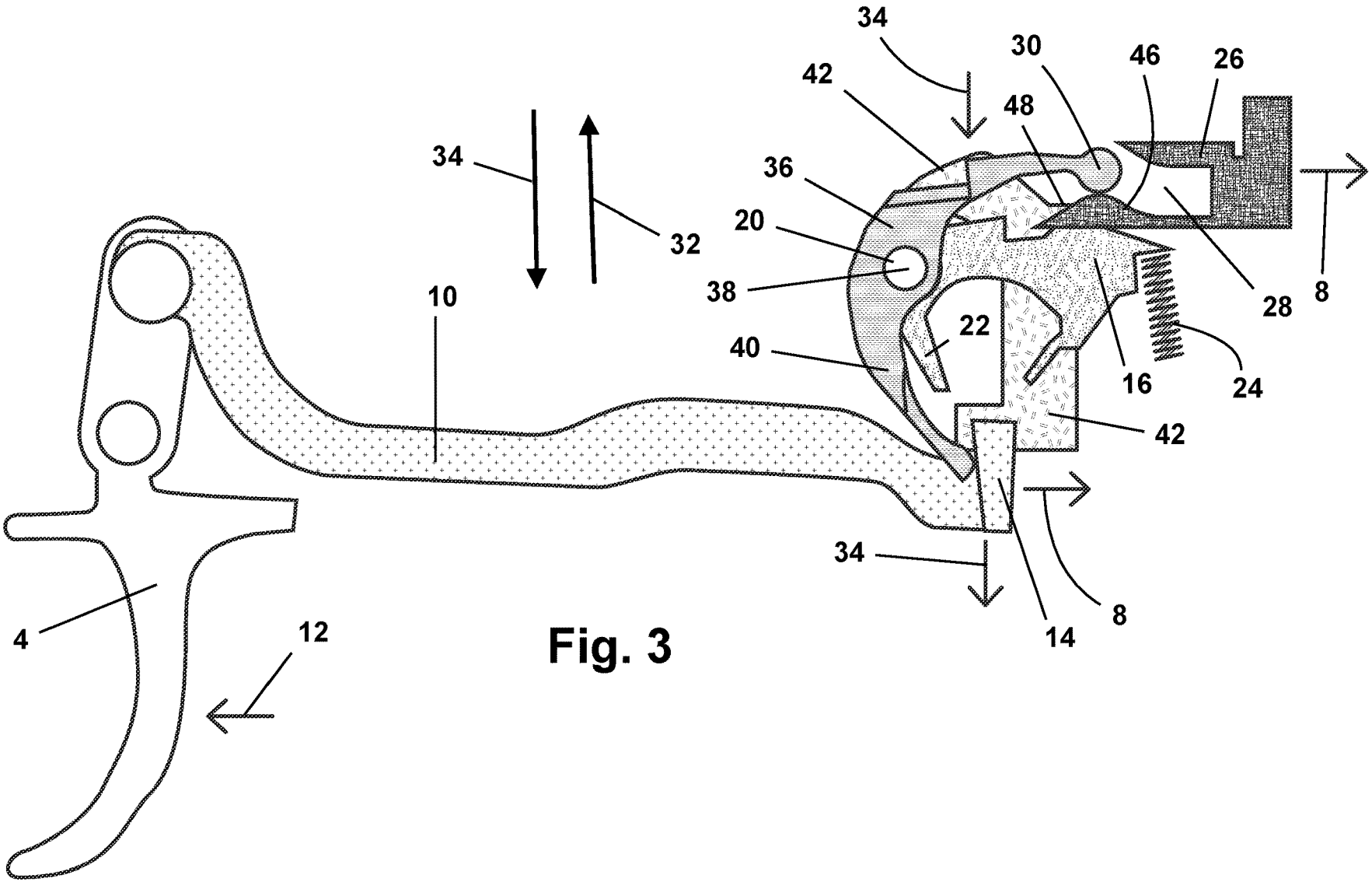
FIG. 3 is the side view of FIG. 1 immediately after the firearm fires when the slide moving in the rearward direction.

FIG. 3 shows the firing mechanism after the time of FIG. 2 and immediately after the cartridge fires and propels a bullet from the firearm in the forward direction 12. Recoil from the fired cartridge propels the slide 64 and hence the housing 52 in the rearward direction 8. The linear cam 26, which is attached to the housing 52, also moves in the rearward direction 8. The linear cam 26 defines a cam profile 28. A cam follower 30 follows the cam profile 28 as the linear cam 26 moves in the rearward direction 8. A first cam surface 46 of the linear cam 26 causes the cam follower 30 to move in an upward direction 32 as the slide moves in the rearward direction 8. As the slide continues to move in the rearward direction 8, the cam follower 30 encounters the second cam surface 48 and moves in a downward direction 34. The cam follower 30 is attached to and a part of a reset bar 36. The reset bar 36 pivots about a reset bar pivot axis 38 as the cam follower 28 moves in the upward and downward directions 32, 34. The reset bar pivot axis 38 may be coextensive with the sear pivot axis 18 and the reset bar 36 may pivot about the sear pin 20.

From FIG. 3, the reset bar 36 has a reset bar lower arm 40. Both the reset bar lower arm 40 and the cam follower 30 are in a spaced-apart relation to the reset arm pivot axis 38. The reset bar lower arm 40 engages the trigger bar projection 14. When the cam follower 30 reaches the limit of its travel along the cam profile 28 in the upward direction (shown by FIG. 3), the reset bar lower arm 40 has pushed the trigger bar projection 14 in the rearward direction 8 so that the trigger bar projection 14 is aft of the sear lower arm 22.

Simultaneously, and as shown by FIG. 3, the rearward-moving slide pushes the disconnector 42 in the downward direction 34. The disconnector 42 bears upon the trigger bar 10 and moves the trigger bar projection 14 in the downward direction 34. The trigger bar projection 14 simultaneously moves downward 34 (pushed by the disconnector 42) and rearward 8 (pushed by the reset arm 36).

In the moment in the cycle shown by FIG. 3, the trigger bar projection 14 is disengaged from the sear 16 and the sear 16 is free to pivot about the sear pivot axis 18. The compressed sear spring 24 pushes on the sear 16, causing the sear 16 to pivot about the sear pivot axis 18 from the firing position to the cocked position (shown by FIG. 3). The sear 16 is now ready to capture the striker when the slide moves in the forward direction 12.

FIG. 4 shows the firing mechanism 2 after the time of FIG. 3, as the slide 64 reaches the limit of its travel in the rearward direction 8 and starts moving in the forward direction 12. The cam follower 30 has followed the cam profile 28 of the linear cam 26 and the position of the cam follower 30 is at the limit of its travel in the downward direction 34. As a result, the reset bar lower arm 40 is disposed at the limit of its travel in the forward direction 12. The shooter's finger is still depressing the trigger 4. The force of the shooter's finger pushes the trigger 4 in the rearward direction 8, which pushes the trigger bar 10 and the trigger bar projection 14 in the forward direction 12 and against the reset bar lower arm 40. The reset bar lower arm 40 therefore limits the motion of the trigger bar 10 and the trigger bar projection 14 in the forward direction 12.

From FIG. 4, the disconnector 42 simultaneously moves in the upward direction 32, allowing the trigger bar projection 14 to move in the upward direction 32. The trigger bar projection 14, now in its forward position, is blocked from moving upward by the lower end 44 of the sear lower arm 22. The force of the trigger bar projection 14 on the lower end 44 of the sear lower arm 22 does not apply a moment to the sear 16 and does not tend to pivot the sear 16 because the force acts through the sear pivot axis 18. The force of the trigger bar projection 14 on the lower end 44 of the sear lower arm 22 does not cause the pistol to fire out of battery.

FIG. 5 shows the firing mechanism 2 after the time of FIG. 4 and as the slide continues to move in the forward direction 12. The sear 16, now in the cocked position, catches the striker (not shown) as it moves forward with the slide 64. The slide 64 continues to move forward, compressing the striker spring (not shown). Simultaneously, the cam second surface 48 encounters the cam follower 30 as the slide 64 moves in the forward direction 12. The cam second surface 48 moves the cam follower 30 in the upward direction 32 and hence the reset bar 36 pushes the trigger bar projection 14 in the rearward direction 8 and out of engagement with the lower end 44 of the sear lower arm 22. The trigger bar projection 14 is now directly behind the sear lower arm 22. The rearward motion of the trigger bar 10 causes the trigger 4 to move in the forward direction 12 against the force of the shooter's finger against the trigger 4.

FIG. 6 shows the firing mechanism 2 immediately after the time of FIG. 5. The slide 64 and hence the housing 52 and the linear cam 26 have continued to move in the forward direction 12. The cam follower 30 follows the cam profile 28 in the downward direction 34 defined by the first cam surface 46. Movement of the cam follower 30 in the downward direction 34 moves the reset bar lower end 40 in the forward direction 12 and out of engagement with the trigger bar projection 14. At the time of FIG. 6, the slide 64 is fully closed, a fresh round is chambered, the striker is retained by the sear 16 in the cocked position and the pistol is ready to fire a second round.

From FIG. 6, the shooter's finger again pulls the trigger 4 in the rearward direction 8. The trigger bar projection 14 is immediately aft of the sear lower arm 22. The force of the shooter's finger on the trigger 4 causes the trigger bar projection 14 to move in the forward direction, causing the sear lower arm 22 to move, causing the sear 16 to pivot and causing the sear 16 to move from the cocked position to the firing position, releasing the striker and firing a second round. The firing mechanism 2 will repeat the cycle shown by FIGS. 1-6 each time the shooter pulls the trigger 4.

As shown by FIGS. 1 and 6, pulling the trigger 4 when the pistol is ready to fire will also cause the trigger bar projection 14 to press upon the reset bar lower arm 40, which will cause the reset arm to pivot and will move the cam follower 30 within the cam profile 28. An adequate cam profile gap 50 is provided to accommodate the movement of the cam follower 30 when the shooter pulls the trigger 4 to fire the pistol.

FIGS. 7 through 12 show the selection mechanism to select between rapid fire and conventional fire. FIGS. 7-10 are views of a housing 52 with the housing 52 partially cut away to show the linear cam 26, the selector 56, and the selector spring 58. From FIGS. 11 and 12 the housing 52 is attachable to and releasable from the rear of the slide 64 in the same manner as the prior art slide rear cap; namely, a dovetail 60 on the housing 52 engages corresponding structure at the back of the slide 64. The housing 52 is retained in engagement with the slide 64 by pressure of the extractor spring, in the same manner as the prior art slide cap. When the housing 52 is attached to the slide 64, the shooter can select between rapid fire and conventional fire. When the housing 52 is not attached to the slide 64, the pistol operates as the prior art pistol discussed in the description of the related art.

Figure 9:
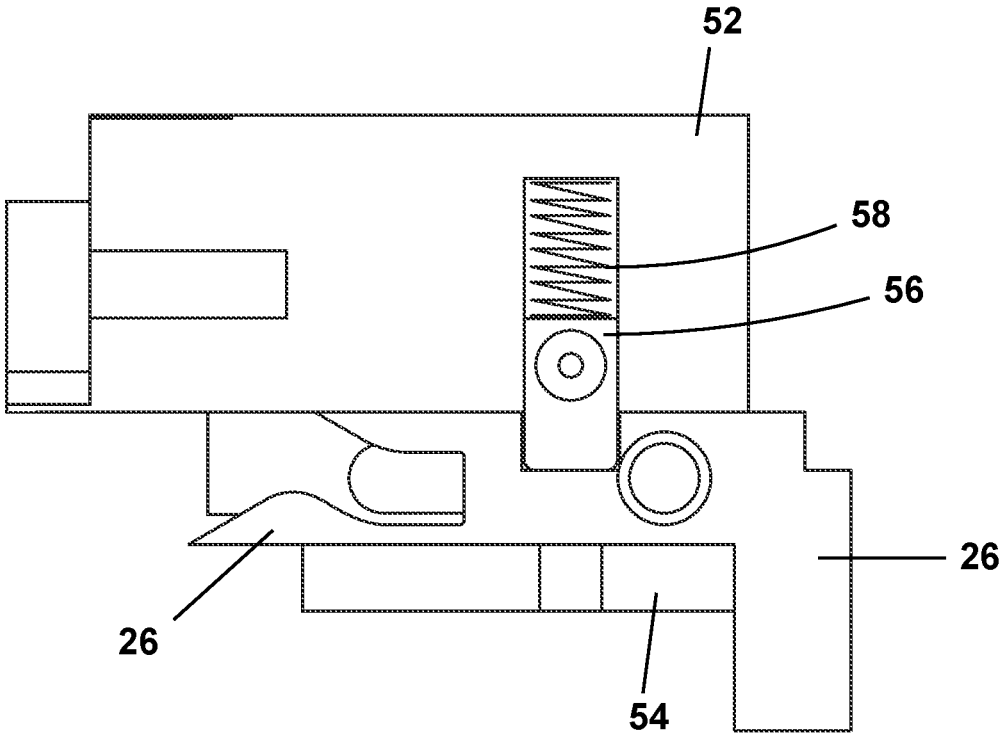
FIG. 9 is a schematic cutaway side view of the housing with the linear cam in the rearward position.
Figure 10:
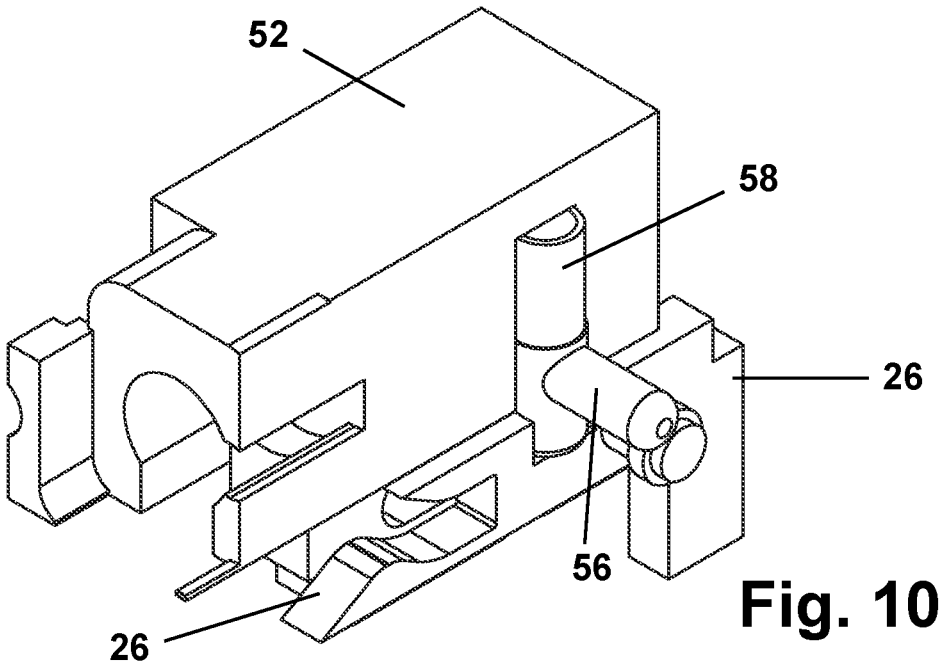
FIG. 10 is a perspective cutaway view of the housing with the linear cam in the rearward position.
Figure 11:
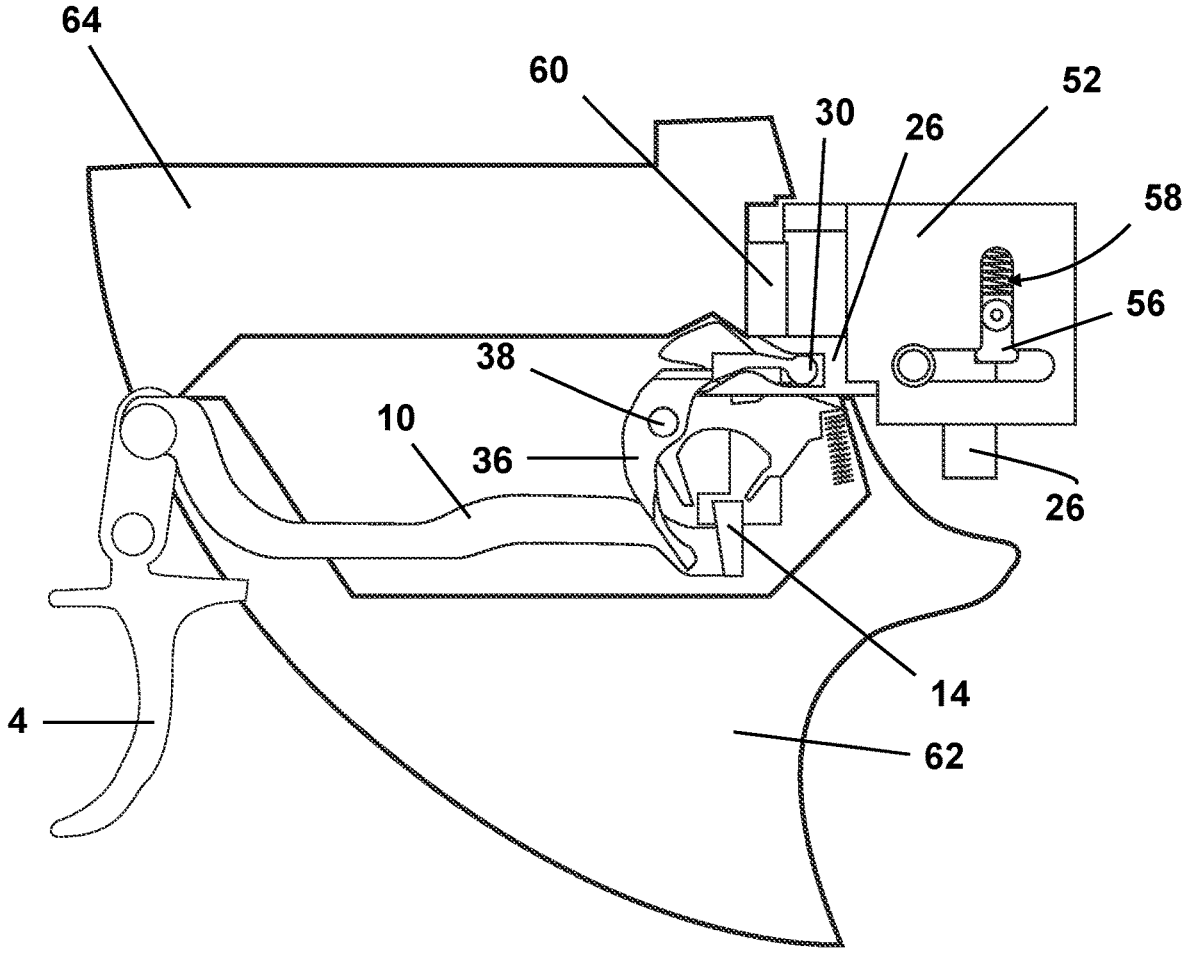
FIG. 11 is a detail side view of the pistol with the housing attached to the rear of the slide and with the linear cam in the forward position.
Figure 12:
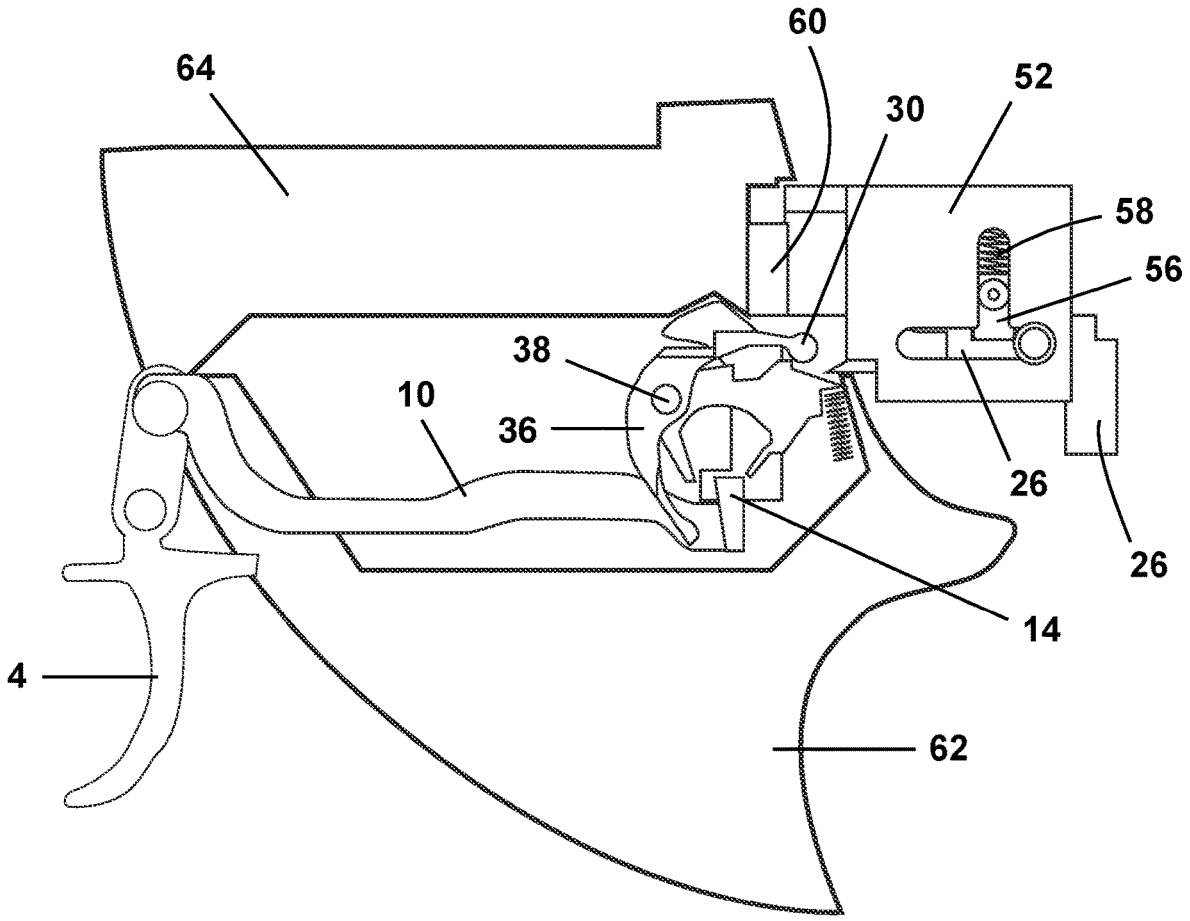
FIG. 12 is the detail side view of FIG. 11 with the linear cam in the rearward position.

When the housing 52 is attached to the rear of the slide 64, the linear cam 26 has two positions: a forward position, shown by FIGS. 1-6, 7, 8 and 11 and a rearward position shown by FIGS. 9, 10 and 12. In the forward position, the linear cam 26 will encounter the cam follower 30 as the slide 64 cycles, resulting in the rapid fire described above for FIGS. 1-6. In the rearward position, the linear cam 26 will not encounter the cam follower 30 and the pistol will fire in the matter described in the discussion of the related art.

FIGS. 11 and 12 show the slide 64 and pistol frame 62 schematically and show the relationship between the firing mechanism of FIGS. 1-6, the housing 52 of FIGS. 7-10, and the slide 64 and frame 62. The frame 62 supports the firing mechanism, including the trigger 4, trigger bar 10, trigger bar projection 14, reset bar 36, and cam follower 30, which do not reciprocate with the slide 64. The slide 64 supports the housing 52, dovetail connector 60, linear cam 26, selector 56 and selector spring 58, all of which reciprocate with the slide 64. To select between rapid fire and conventional fire, the shooter will move the release pin 56 upward against the pressure of release spring 58 and slide the linear cam 26 between the forward and rearward positions. The shooter then releases the release pin 56, which engages the linear cam 26 to lock the linear cam 26 in the selected position. Any other mechanism known in the art to selectably and reversibly fix one object to another, such as a fastener, clip, detent, cam, pin, bayonet connection, slot or groove, may be used to selectably affix the linear cam 26 in the forward position or in the rearward position with respect to the housing 52 and the slide 64. The housing 52 may dispense with the selection mechanism entirely and may have the linear cam 26 fixed in the forward position.

The following is a list of the numbered elements of the claims and drawings.

firing mechanism 2
trigger 4
trigger axis of rotation 6
rearward direction 8
trigger bar 10
forward direction 12
trigger bar projection 14
sear 16
sear pivot axis 18
sear pin 20
sear lower arm 22
sear spring 24
linear cam 26
cam profile 28
cam follower 30
upward direction 32
downward direction 34
reset bar 36
reset bar pivot axis 38
reset bar lower arm 40
disconnector 42
sear lower end 44
cam first surface 46
cam second surface 48
cam profile gap 50
housing 52
bracket 54
selector pin 56
selector spring 58
dovetail connection 60
pistol frame 62
slide 64

I claim:

1. A firing mechanism for a semi-automatic pistol having a slide, the firing mechanism comprising:

a) a trigger;

b) a trigger bar operably attached to the trigger, the trigger bar having a configuration for a movement in a first direction upon activation of the trigger;

c) a sear, the sear being movable by the trigger bar from a sear cocked position to a sear firing position in response to the movement of the trigger bar in the first direction, the sear being configured to release a striker to fire the pistol when the sear moves from the sear cocked position to the sear firing position in response to the movement of the trigger bar in the first direction;

d) a linear cam, the linear cam having a cam profile, the linear cam having a configuration to reciprocate in a reciprocating movement with the slide when the pistol is fired;

e) a cam follower, the cam follower being configured to follow the cam profile in response to the reciprocating movement of the linear cam;

a reset bar, the reset bar being attached to the cam follower, the reset bar having a configuration to move in response to the reciprocating movement of the linear cam, the reset bar being configured to move the trigger bar in a second direction opposite to the first direction when the linear cam reciprocates and to define a limit on the movement of the trigger bar in the first direction when the linear cam reciprocates.

2. The firing mechanism of claim 1 wherein the configuration of the linear cam for the reciprocating movement with the slide is that the linear cam is attachable to and removable from the slide.

3. The firing mechanism of claim 2, the configuration of the linear cam for the reciprocating movement with the slide further comprising: a housing, the housing being selectably attachable to and removable from the slide, the linear cam being attached to the housing.

4. The firing mechanism of claim 3 wherein the linear cam has a selectable forward position and a selectable rearward position with respect to the housing, the linear cam being selectably fixable in the forward position and the rearward position, the linear cam being configured to engage and to move the cam follower during the reciprocating movement of the linear cam when the housing is attached to the slide and the linear cam is fixed in the forward position.

5. The firing mechanism of claim 4 wherein the linear cam is configured not to engage and not to move the cam follower during the reciprocating movement of the linear cam when the housing is attached to the slide and the linear cam is fixed in the rearward position.

6. The firing mechanism of claim 5, further comprising: means to selectably fix the linear cam in the forward position and the rearward position with respect to the housing.

7. The firing mechanism of claim 1 wherein the configuration of the reset bar to move in response to the reciprocating movement of the linear cam when the pistol is fired comprises: the reset bar defines a reset bar pivot axis about which the reset bar is configured to pivot.

8. The firing mechanism of claim 7 wherein the configuration of the reset bar to move the trigger bar in the second direction comprises: a reset bar lower arm, the reset bar lower arm being in a spaced-part relation to the reset bar pivot axis, the cam follower being in a spaced-apart relation to the reset bar lower arm and to the reset bar pivot axis, the cam profile being configured to cause the reset bar lower arm to bear upon the trigger bar when the linear cam reciprocates and to move the trigger bar in the second direction.

9. The firing mechanism of claim 8 wherein the pistol defines a forward direction corresponding to the direction of travel of a bullet fired from the pistol and defines a rearward direction opposite to the forward direction and wherein the reciprocating movement of the linear cam when the pistol is fired comprises: a linear cam movement in the rearward direction, followed by the linear cam movement in the forward direction and wherein the cam profile is configured to move the trigger bar in the second direction when the linear cam movement is in the forward direction.

10. The firing mechanism of claim 9 wherein the first direction is the forward direction and the wherein the second direction is the rearward direction.

11. The firing mechanism of claim 7 wherein the configuration of the reset bar to limit the motion of the trigger bar in the first direction when the linear cam reciprocates comprises: a reset bar lower arm, the reset bar lower arm being in a spaced-part relation to the reset bar pivot axis, the cam follower being in a spaced-apart relation to the reset bar lower arm and to the reset bar pivot axis, the cam profile being configured to cause the reset bar lower arm to move in the second direction and to block the movement of the trigger bar in the first direction when the linear cam reciprocates.

12. The firing mechanism of claim 11 wherein the pistol defines a forward direction corresponding to the direction of travel of a bullet fired from the pistol and defines a rearward direction opposite to the forward direction and wherein the reciprocating movement of the linear cam when the pistol is fired comprises: a linear cam movement in the rearward direction, followed by a linear cam movement in the forward direction and wherein the cam profile is configured to move the reset bar lower end in the second direction and to block the movement of the trigger bar in the first direction when the linear cam movement is in the rearward direction.

13. The firing mechanism of claim 12 wherein the first direction is the forward direction and the wherein the second direction is the rearward direction.

14. The firing mechanism of claim 7 wherein the configuration of the sear to release the striker when the sear moves from the sear cocked position to the sear firing position comprising: the sear being rotatable about a sear pivot axis between the sear cocked position and the sear firing position, the sear pivot axis being coextensive with the reset bar pivot axis.

15. The firing mechanism of claim 14 wherein the sear is pivotable about a sear pin to define the sear pivot axis, the reset bar being pivotable about the sear pin to define the reset bar pivot axis.

16. The firing mechanism of claim 1 wherein the pistol defines a forward direction corresponding to the direction of travel of a bullet fired from the pistol and defines a rearward direction opposite to the forward direction, wherein the reciprocating movement of the linear cam is in the rearward direction and then in the forward direction, and wherein the linear cam defines a first cam surface and a second cam surface, the first cam surface being disposed rearward of the second cam surface, the cam profile comprising the first cam surface and the second cam surface.

17. The firing mechanism of claim 16 wherein when the linear cam is moving in the rearward direction from a closed position, the cam follower first engages the first cam surface and subsequently engages the second cam surface, when the linear cam is moving in the rearward direction the first cam surface moves the reset bar lower arm in the second direction and subsequently the second cam surface moves the reset bar lower arm in the first direction.

18. The firing mechanism of claim 17 wherein when the linear cam is moving in the forward direction from an open position the cam follower first engages the second cam surface and subsequently engages the first cam surface, when the linear cam is moving in the forward direction the second cam surface moves the reset bar lower arm in the second direction and subsequently the first cam surface moves the reset bar lower arm in the first direction.

19. The firing mechanism of claim 1 further comprising:

a) a sear lower arm, the sear lower arm being attached to the sear, the sear being pivotable about a sear pivot axis, the sear lower arm being configured to rotate the sear about the sear pivot axis from the sear cocked position to the sear firing position;

b) a trigger bar projection attached to and movable with the trigger bar, the trigger bar projection having a trigger bar firing position when the trigger bar projection is aft of the sear lower arm, the trigger bar projection being configured to engage the sear lower arm and to pivot the sear from the sear cocked position to the sear firing position to fire the pistol upon activation of the trigger by a shooter when the trigger bar projection is in the trigger bar firing position;

c) the slide, wherein upon firing of the pistol the slide is configured to move in a rearward direction from a slide closed position and subsequently to return in a forward direction to the slide closed position, the slide being configured to reload the pistol and to return the sear to the sear cocked position when the slide moves in the forward direction so that the pistol is ready to fire when the slide returns to the slide closed position, the configuration of the reset bar to limit the movement of the trigger bar in the first direction when the linear cam reciprocates is that the reset bar interferes with the trigger bar projection and prevents the trigger bar projection from moving the sear to the firing position until the slide returns in the forward direction to the slide closed position, wherein a second activation of the trigger by a shooter will cause a second round to fire from the pistol only when the slide returns in the forward direction to the slide closed position.

* * * * *